US011046504B2

(12) United States Patent
Fernandez

(10) Patent No.: US 11,046,504 B2
(45) Date of Patent: Jun. 29, 2021

(54) INTEGRATED BANANA PACKING, TRANSPORTATION, AND COMMERCIALIZATION SYSTEM

(71) Applicant: Breakthrough Solutions, LLC, Weston, FL (US)

(72) Inventor: Raul Ubaldo Fernandez, Weston, FL (US)

(73) Assignee: Breakthrough Solutions LLC, Weston, FL (US)

( * ) Notice: Subject to any disclaimer, the term of this patent is extended or adjusted under 35 U.S.C. 154(b) by 344 days.

(21) Appl. No.: 16/101,685

(22) Filed: Aug. 13, 2018

(65) Prior Publication Data

US 2019/0047779 A1 Feb. 14, 2019

Related U.S. Application Data

(60) Provisional application No. 62/544,182, filed on Aug. 11, 2017.

(51) Int. Cl.

| | |
|---|---|
| ***B65D 85/34*** | (2006.01) |
| ***B65B 55/00*** | (2006.01) |
| ***B65D 71/00*** | (2006.01) |
| ***B65D 81/07*** | (2006.01) |
| ***B65B 5/06*** | (2006.01) |

(Continued)

(52) U.S. Cl.

CPC ..... *B65D 85/345* (2013.01); *B65B 5/067* (2013.01); *B65B 25/046* (2013.01); *B65B 55/00* (2013.01); *B65D 5/52* (2013.01); *B65D 71/0096* (2013.01); *B65D 81/07* (2013.01);

(Continued)

(58) Field of Classification Search

CPC .. B65B 5/02; B65B 5/024; B65B 5/04; B65B 5/045; B65B 5/06; B65B 5/067; B65B 25/001; B65B 25/04; B65B 25/041; B65B 25/046; B65B 2220/16; B65B 2220/18; B65B 55/00; B65D 5/52; B65D 71/0096;

(Continued)

(56) References Cited

U.S. PATENT DOCUMENTS 597,391 A * 1/1898 Carpenter ..... B65D 85/302 217/52

815,704 A 3/1906 Hirsch (Continued)

OTHER PUBLICATIONS

International Search Report and Written Opinion dated Oct. 18, 2018, for PCT/US2018/046473, pp. 1-12.

*Primary Examiner* — Anna K Kinsaul
*Assistant Examiner* — Luis G Del Valle
(74) *Attorney, Agent, or Firm* — The Concept Law Group, PA; Scott D. Smiley; Scott M. Garrett

(57) ABSTRACT

A packaging and container system addresses the different needs for packaging bananas, transporting the bananas, and displaying the bananas for sale, all in the same container. The system uses a box or box frame, and at least one perimeter wall that is an independent piece. A film (e.g. plastic sheet) is used to suspend the bananas inside the box during transport to prevent or reduce friction or rubbing between bananas and between the bananas and the sides of the container. Once packed, the box can rotated to its transport position where the bananas are suspended within the film inside the container. Once at the retail location, the container can again be laid on a side and a perimeter wall removed to expose and display the bananas.

6 Claims, 21 Drawing Sheets

(51) Int. Cl.
*B65B 25/04* (2006.01)
*B65D 5/52* (2006.01)

(52) U.S. Cl.
CPC ..... *B65B 2220/18* (2013.01); *B65D 2205/02* (2013.01); *B65D 2571/00061* (2013.01)

(58) Field of Classification Search
CPC ..... B65D 81/07; B65D 2205/02; B65D 2571/00061
USPC ..... 53/499, 173–175, 452; 493/93, 95, 96, 493/100
See application file for complete search history.

(56) References Cited

U.S. PATENT DOCUMENTS

| | | | | |
|---|---|---|---|---|
| 1,014,951 | A | 1/1912 | Cornell | |
| 2,599,708 | A * | 6/1952 | Gottesman | B65D 5/606 229/152 |
| 3,522,905 | A * | 8/1970 | Wei | B65D 5/54 229/120 |
| 2006/0172044 | A1 * | 8/2006 | Fernandez | B65D 77/062 426/106 |

* cited by examiner

Prior Art

100

Prior Art

200

Prior Art

200

Prior Art

INTEGRATED BANANA PACKING, TRANSPORTATION, AND COMMERCIALIZATION SYSTEM

CROSS REFERENCE

This non-provisional application is based on, and claims priority to provisional application No. 62/544,182, filed Aug. 11, 2017, the entirety of which is hereby incorporated by reference.

FIELD OF THE INVENTION

The present invention relates generally to an integrated banana packing, transportation, and commercialization system, and, more particularly, to a container including a protective inner packaging that can be used to efficiently pack, transport, and display bananas, greatly reducing labor and material costs during each phase of the process of commercializing bananas.

BACKGROUND OF THE INVENTION

Currently, the majority of bananas are shipped and commercialized using a system that was developed in the 1960s. As shown in FIG. 1, the current system is comprised of a two-piece telescoping corrugated cardboard box 100, including a top cover 102 and a bottom component 104, and includes inner packing materials made with plastic film and paper, which create a protective environment for bananas. The main purpose of the current system is to efficiently and economically deliver green bananas to receivers in the market, with minimal bruising and premature ripening fruit. In turn, the receivers ripen and commercialize the bananas for distribution to retailers. Finally, retailers remove the bananas by hand, one cluster at a time, and place them on display tables for shoppers to pick from.

One problem with this system is that, since it was developed in the $20^{th}$ century, paper and labor costs have increased. While the traditional system uses disposable cardboard, plastic, and paper components, the increased costs associated with the system has created an opportunity for returnable packaging components.

Over the last 12 years, numerous attempts have been made at developing a successful new packaging system for the banana trade. Most efforts focused on replacing the industry-standard cardboard containers, but use the same general packing configuration of the traditional system. As shown in FIGS. 2-3, other efforts have focused on creating a collapsible Returnable Plastic Container (RPC) 200, such as by attempting to adjust to a 16"×24" footprint in order to maintain uniformity with other RPC systems.

However, most efforts to change the banana packing industry have been stymied by certain barriers. For example, one such barrier is that of the avoidance and prevention of damage during transportation. As shown in FIG. 4, bananas are typically packed on top of and/or adjacent to each other, such that clusters are in contact with other clusters and with the walls of the container, which can cause damage during transportation. The main barrier has, nevertheless, proven to be economical—namely, new methods have been incapable of matching the packing load per ocean-going container of the traditional system, which uses non-returnable corrugated cardboard half-slotted containers (HSCs). To date, there has been no successful replacement for the HSC containers.

RPC companies have continued to focus on attempting to emulate the current cardboard solutions, with returnable components. These efforts, though, are still very limited in their ability to protect fruit in transit, and require substantial labor to display the fruit in an attractive format at retail.

Lately, the retail industry has been increasingly demanding a packaging solution that would deliver bananas that are substantially display-ready, and would require less labor to display the fruit once received at the store, while retaining the main benefits provided by the current system.

Attempts to create these features of cardboard boxes have resulted in open-top display containers that neither protect the quality of the fruit nor improve the attractiveness of the display. In reality, the open-top display containers result in a detriment of the quality and appearance of the fruit at retail. There is still an unmet need to develop a packaging container that meets the varying demands of each party involved in the complex industry of banana packing, transportation, and display.

Therefore, a need exists to overcome the problems with the prior art as discussed above.

SUMMARY OF THE INVENTION

In accordance with some embodiments of the inventive disclosure, there is provided an integrated packing, transportation, and commercialization system that includes a container that has a top wall, a first side wall opposite a second side wall, the first and second side walls coupled to the top wall, and a perimeter wall spanning from the first side wall to the second side wall and coupled to the top wall. The container further includes a covering coupled to the top wall and spanning the perimeter wall. The covering is configured to create a seal around a plurality of bananas stored within the container. The container also has an opening defined by the container, and opposite the perimeter wall, where the opening is sized and shaped to receive the plurality of bananas.

the covering is a film tube that suspends the plurality of bananas inside the container when the container is in an upright position.

Embodiments can further provide that the perimeter wall is removable to convert the container from a transport configuration to a display configuration.

Embodiments can further provide that the top wall, first side wall, second side wall, and perimeter wall are comprised of corrugated cardboard.

In accordance with a further feature, there can be a bottom member having side walls that are sized to fit within the container along the first and second side walls of the container, respectively, and bottom that is sized to cover the opening.

In accordance with some embodiments of the inventive disclosure, there is provided a container system for packaging, transporting, and displaying bananas and similar agricultural products that includes a box frame having opposing long sides, and opposing short sides, and having a top wall and defining an interior. The system can further include a first perimeter wall and a second perimeter wall; and a film tube arranged to encircle portions of the first and second perimeter walls. The first perimeter wall can include a long side that spans a first one of the opposing long sides of the box frame. The second perimeter wall can include a long side that spans a second one of the opposing long sides of the box frame. The film tube is sized to thereby suspend contents contained between the first and second perimeter walls inside the box frame when the box frame is in an upright position.

In accordance with a further feature, the first and second perimeter walls can each include a short side that is contiguous with the respective long side of each of the first and second perimeter walls. The short side of each of the first and second perimeter walls can be sized to fit against a respective one of the opposing short sides of the box frame within the box frame.

In accordance with a further feature, the film tube comprises a plurality of aeration openings.

In accordance with a further feature, the box frame and the first and second perimeter walls are comprised of corrugated cardboard.

In accordance with a further feature, the box form is sized so that a plurality of box frames can be stacked in layers of six by one and two by two on a 40 inch by 48 inch pallet.

In accordance with a further feature, the container can further include a bottom member having opposing sides that each fit within the box frame along a respective one of the opposing sides of the box frame, and a bottom that is sized to cover a bottom of the box frame.

In accordance with a further feature, the container system is configured to be converted from a transport configuration to a display configuration by removing one of the perimeter walls.

In accordance with some embodiments of the inventive disclosure, there is provided a method of arranging a container system for packaging, transporting, and displaying bananas, comprising providing a box frame having opposing long sides, and opposing short sides, and having a top wall and defining an interior. The method can further include providing a first perimeter wall and a second perimeter wall, each having a long side. The method can further include providing a film tube that is sized to encircle portions of the first and second perimeter walls. The method can further include configuring the first and second perimeter walls adjacent each other on a surface such that the long sides of the first and second perimeter walls are parallel to each other, and placing the box frame on one of the long sides of the box frame. The method can further include placing the film tube over the long sides of the first and second perimeter walls such that the long sides of the perimeter walls are inside the film tube. The method can further include placing a plurality of bananas on the long side of the first perimeter wall, and inverting the second perimeter wall over, and on top of the bananas and the first perimeter wall. After inverting the second perimeter wall, the method can further include placing the first and second perimeter wall and the film tube with the bananas captured between the first and second perimeter walls into the interior of the box frame. The method can further include rotating the box frame with the bananas contained therein into an upright position, wherein in the upright position, the bananas are suspended in the interior of the box frame between the first and second perimeter walls by the film tube.

In accordance with as further feature, the method can further include providing a bottom member having opposing sides that each fit within the box frame along a respective one of the opposing sides of the box frame, and a bottom that is sized to cover a bottom of the box frame, and placing the opposing sides of the bottom member into the interior of the box frame, thereby forming a bottom of the container system.

In accordance with a further feature, the method can further include providing each of the first and second perimeter walls with a short side that is contiguous with the respective long side of each of the first and second perimeter walls. The short side of each of the first and second perimeter walls can be sized to fit against a respective one of the opposing short sides of the box frame within the box frame.

In accordance with a further feature, the method can further include converting the container system from a transport configuration to a display configuration by placing the box frame with the bananas disposed in the interior of the box frame on a surface one of the long sides of the box frame, and removing the one of the first and second perimeter walls that is uppermost upon placing the box frame on the long side.

In accordance with a further feature, the method can further include providing the film tube including a plurality of aeration openings.

In accordance with a further feature, the method can further include providing the box frame having a length of 23 to 24 inches, a height of 10 to 11 inches, and a depth of 7 to 8 inches.

Although the invention is illustrated and described herein as embodied in an integrated banana packing, transportation, and commercialization system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Some detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing Figures, in which like reference numerals are carried forward. The Figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant FIG. In this document, the term "longitudinal" should be understood to mean in a direction corresponding to an elongated direction of the container along the perimeter wall from side wall to side wall. As used herein, the phrase "sized to fit" means the structure has dimensions that allow it to fit within, over, around, about, or in operative engagement with another referenced structure or item.

BRIEF DESCRIPTION OF THE DRAWINGS

The accompanying drawings, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

The invention provides an integrated banana packing, transportation, and commercialization system that introduces a novel and efficient packaging system for banana clusters, individual banana fingers, and similar fruits, vegetables, and other agricultural products. The system also utilizes an inner packing design that protects bananas during transit and which, once separated from the transportation container, allows for the container to become a display fixture for bananas, reducing the labor costs in displaying bananas in retail locations. Alternatively, the bananas can be removed from the container and displayed at retail with minimal amount of labor and handling. Advantageously, the invention can still be easily packed in current packing facilities and transported by the same current methods.

Figure 5:
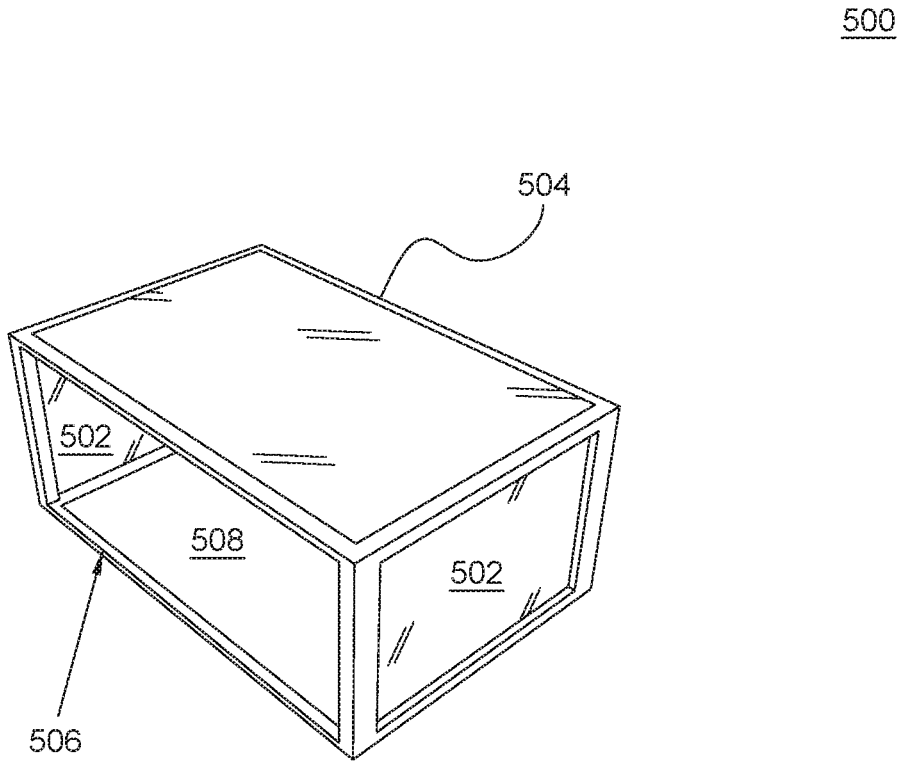
FIG. 5 is a perspective view of a box and packaging system for bananas and similar fruits, in accordance with some embodiments.

The present invention provides a novel and efficient integrated banana packing, transportation, and commercialization system that is capable of protecting bananas, preventing damage during transportation, and displaying bananas with minimal handling. As used herein, "bananas" shall not be limited to bananas, but shall include all types of fruits and vegetables which may be stacked and transported to retail locations, such as apples, carrots, potatoes, tomatoes, and the like. Referring now to FIG. 5, one embodiment of the present invention is shown in a perspective view. FIG. 5 shows several advantageous features of the present invention, but, as will be described below, the invention can be provided in several shapes, sizes, combinations of features and components, and varying numbers and functions of the components. The product may also be used in various applications. The first example of an integrated banana packing, transportation, and commercialization system, as shown in FIG. 5, may include a container 500, including side walls 502, top wall 504, bottom wall 508, and opening 506. Alternatively, the container 500 may not include the bottom wall 508, instead forming a seal with a pallet or another container 500 during transportation.

Figure 6:
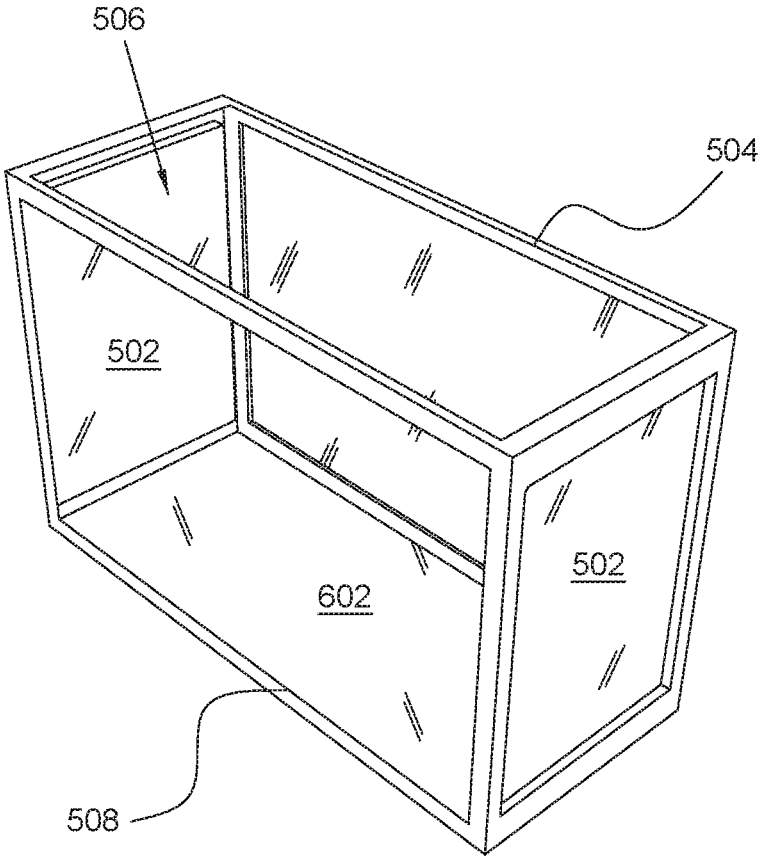
FIG. 6 is a perspective view of the box of FIG. 5 in a rotated position.

Referring now to FIG. 6, the container 500 is shown in an inverted position which is ideal for packing. Bananas may be inserted and stored within the container 500 through openings 506 and/or 508 and against perimeter wall 602. When the container 500 is full, opening 506 may become another perimeter wall 602, thereby sealing the bananas within the container 500 for transportation. Ideally, bananas may be packed within the container 500 from side wall 502 to side wall 502, such that the bananas are stored efficiently and effectively. In one embodiment, each side wall may measure 15¼" in length, and 9¹³⁄₁₆" in height. Similarly, in one embodiment, top wall 504 and bottom wall 508 may each measure 23⁹⁄₁₆" in length, and 15¼" in height. Finally, in one embodiment, perimeter walls 602 may each measure 23⁹⁄₁₆" in length, and 9¹³⁄₁₆" in height. As such, the side walls 502, top wall 504, bottom wall 508, and perimeter walls 602 may form a singular structure that is rigid and supported, such that the container 500 may be capable of holding as much as 45 pounds of bananas that are evenly distributed within the container 500, although more typically the content weight will be on the order of approximately twenty seven to twenty eight pounds. It is appreciated that the recited lengths, heights, and weights are merely rough dimensions and estimations, and should not be used to limit the claimed invention to less than a 50% variance/tolerance of these numbers. For example, the dimensions of the side walls 502 and the top wall 504 may be such that a multiple of 4, 5, 6, or more containers 500 can be arranged on an industry standard transportation pallet to reduce the environmental footprint of shipping the containers 500. As used herein, an industry standard transportation pallet means a transportation pallet measuring approximately 40" by 48".

In one embodiment, the bottom wall 508 may be made of a stronger and more resilient material than the top wall 504, the side walls 502, and the perimeter walls 602, since the bottom wall 508 must support the weight of the bananas during transportation. In an alternative embodiment, each wall is made of substantially the same material. The walls may be securely attached to each other by traditional methods. In one embodiment, the walls may be selectively coupled to each other, such as by a hinge or other built-in hinging mechanism, allowing for the selective removal or folding of an individual wall. In one embodiment, the walls may be capable of folding away from the container 500, allowing a user to access the contents of the container 500 without destroying the container 500. In another embodiment, the container 500 may be telescopic, where the top wall 504 and side walls 502 may form a singular structure which may be removable from a bottom component, which may include the bottom wall 508 and a second set of side walls 502, similar to currently-used structures.

Figure 1:
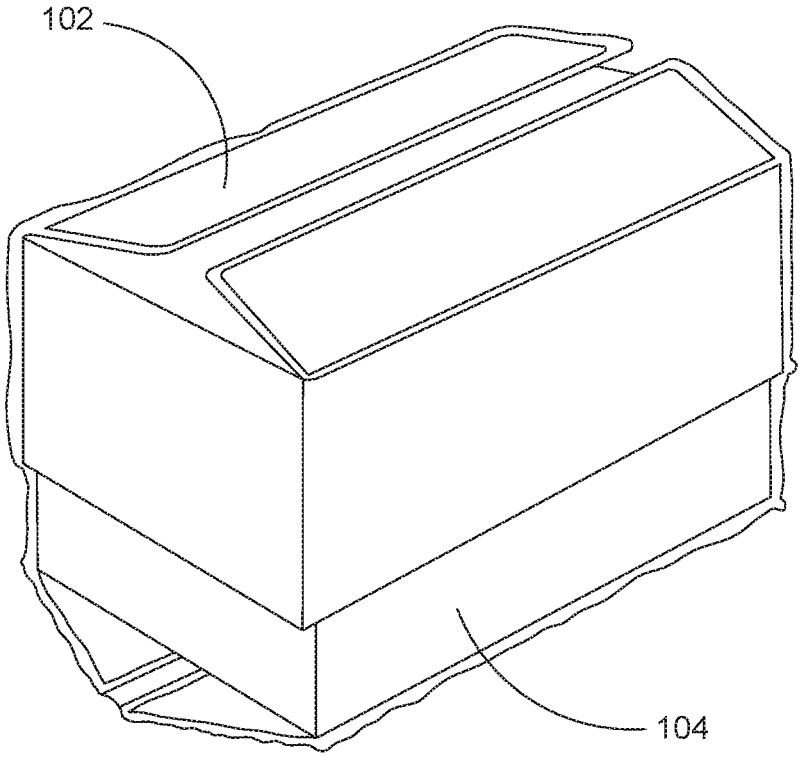
FIG. 1 is a prior art box system for packaging, transporting, and displaying bananas.
Figure 2:
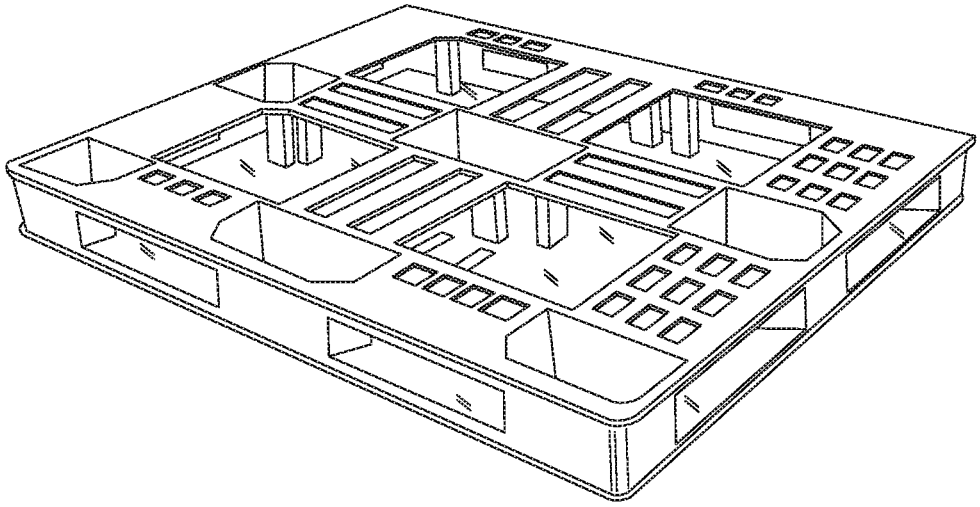
FIG. 2 is prior art base for a returnable plastic container used in the packaging and transport of bananas, shown in its collapsed or folded form.
Figure 3:
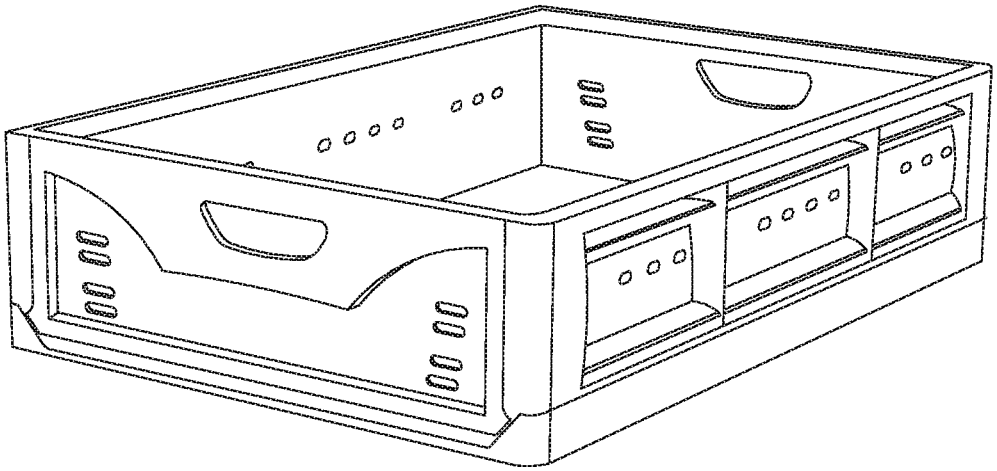
FIG. 3 a prior art returnable plastic container used in the packaging and transport of bananas, shown in the opened or ready to be packed form.
Figure 4:
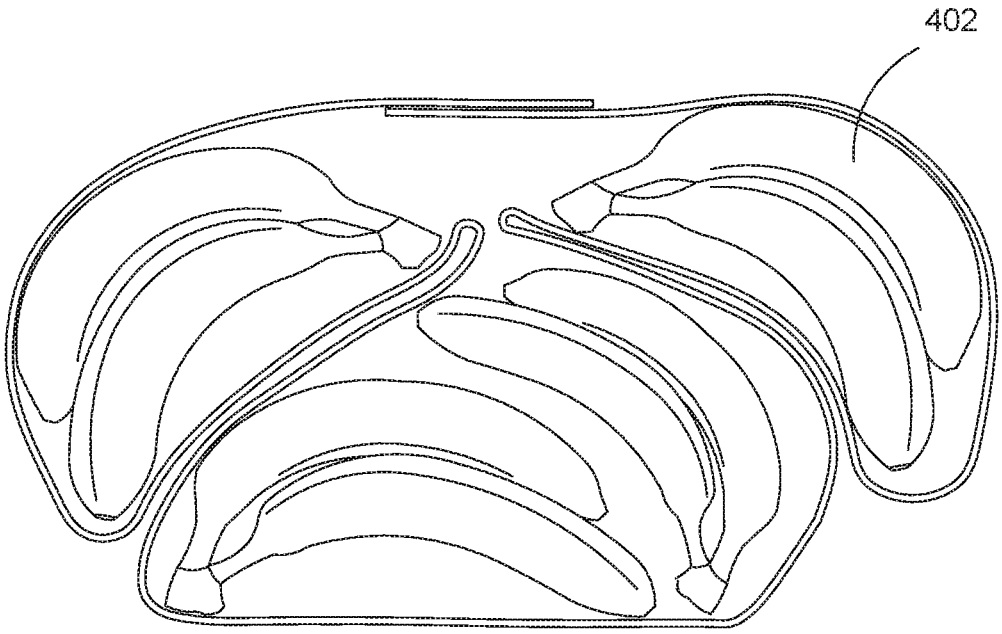
FIG. 4 is a side view showing bananas packaged in accordance with prior art methods.
Figure 7:
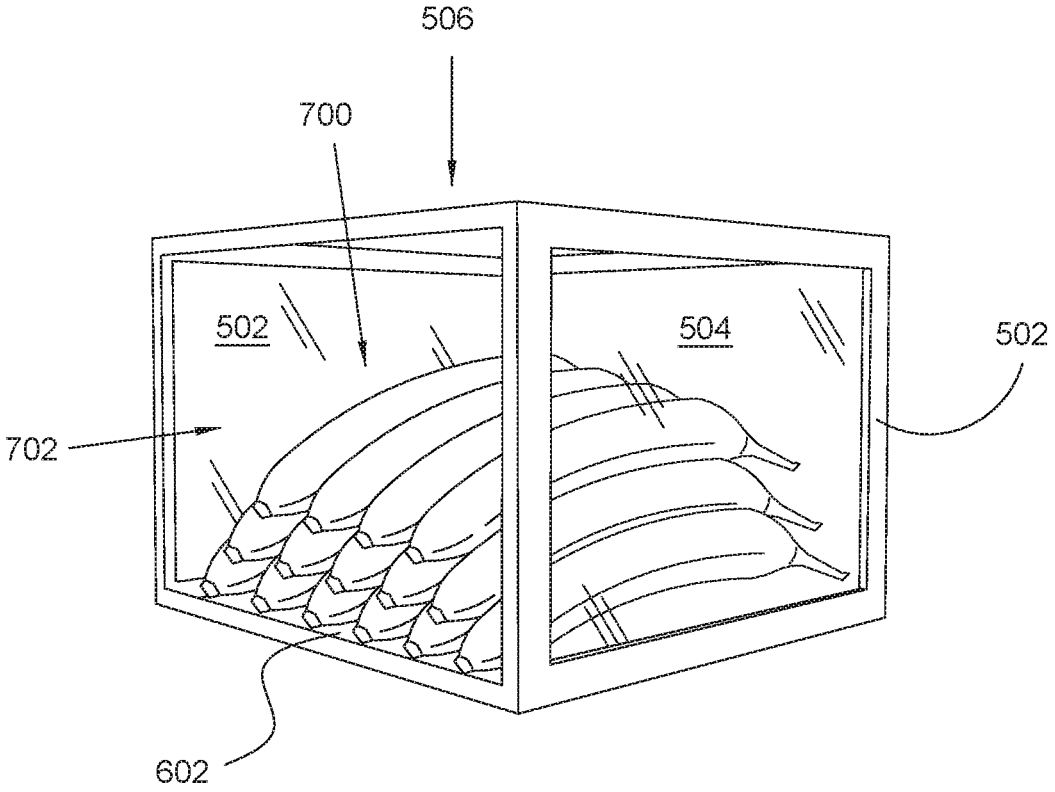
FIG. 7 is a side perspective view of a box and packaging system for bananas and similar fruits, with bananas partially filling the box, in accordance with some embodiments.
Figure 8:
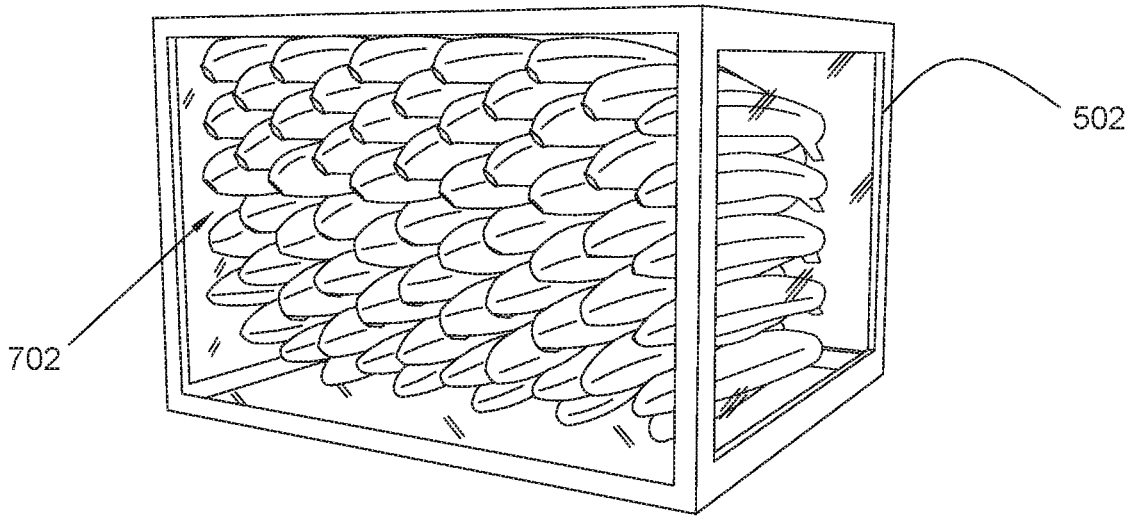
FIG. 8 is a side perspective view of a box and packaging system for bananas and similar fruits, with bananas filling the box, in accordance with some embodiments.

Referring now to FIGS. 7-8, a method of packing bananas into the container 500 is shown. In one embodiment, bananas are packed into the container 500 through opening 506 and against perimeter wall 602, in a general direction 700. The container 500 may be packed such that individual banana clusters lay side-by-side and on top of each other in the container 500, spanning from side wall 502 to side wall 502, and from top wall 504 to bottom wall 508, as shown in FIG. 8. Because the bananas are packed in such an organized way, it is possible to pack more bananas into the containers 500 because there is less space loss as a result of inefficient packing methods, such as those shown in FIG. 4.

In one embodiment, the container 500 includes covering 702 which is attached to bottom wall 508, and which may be a film made of plastic or a similar material, or may be a composition including plastic and similar materials. Covering 702 is operably configured such that it envelops the bananas and suspends the bananas between the top wall 504 and the bottom wall 508 during transportation. Further, covering 702 prevents the bananas from suffering damage during transportation by reducing friction between individual clusters of bananas and between the bananas and the walls of the container. In one embodiment, covering 702 attaches to both the top wall 504 and the bottom wall 508, loosely preventing clusters of bananas from moving during transportation. In another embodiment, covering 702 may form a tight seal from top wall 504 to bottom wall 508, such as by forming a vacuum seal, securing the bananas from movement and preventing damage. In another embodiment, covering 702 attaches to top wall 504 and extends toward bottom wall 508, while not contacting bottom wall 508, thereby surrounding bananas in a cocoon-like envelope.

Figure 9:
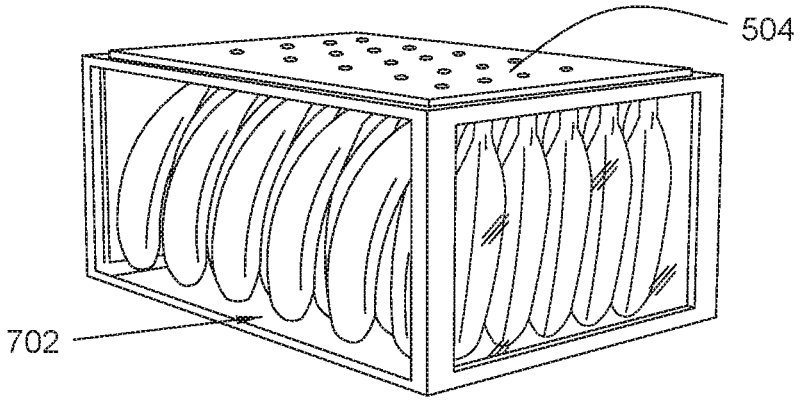
FIG. 9 is a side perspective view of a box and packaging system for bananas and similar fruits with the box in position for transport, in accordance with some embodiments.

Referring now to FIG. 9, the container 500 is shown in its transportation configuration, with the top wall 504 on top, and the bottom wall 508 on bottom. Because the covering 702 substantially surrounds the bananas from top wall 504 to bottom wall 508, the bananas are suspended within the covering 702, and do not directly contact any of the top wall 504, bottom wall 508, or side walls 502. As such, the bananas are largely prevented from damage during transportation.

Figure 10:
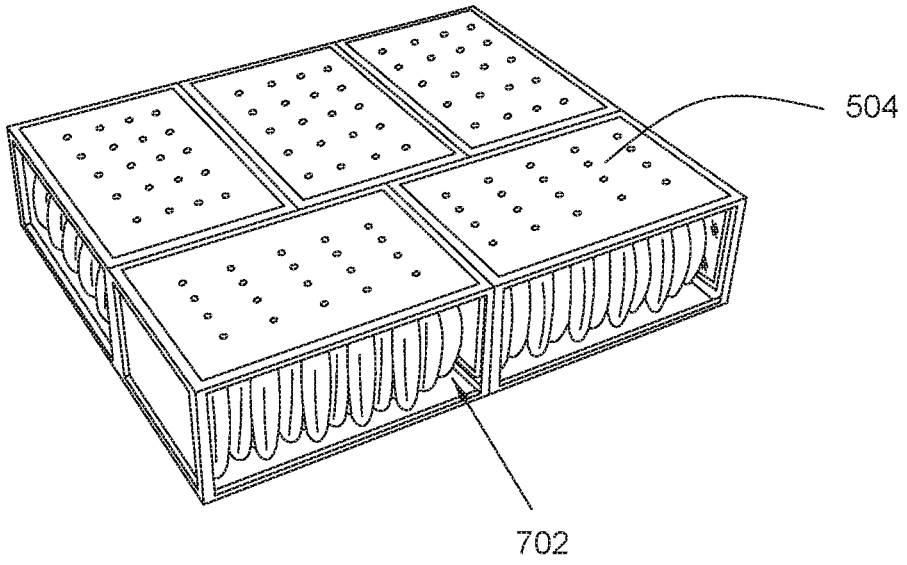
FIG. 10 is a perspective view of boxes of bananas arranged in a first layer for transport, in accordance with some embodiments.
Figure 11:
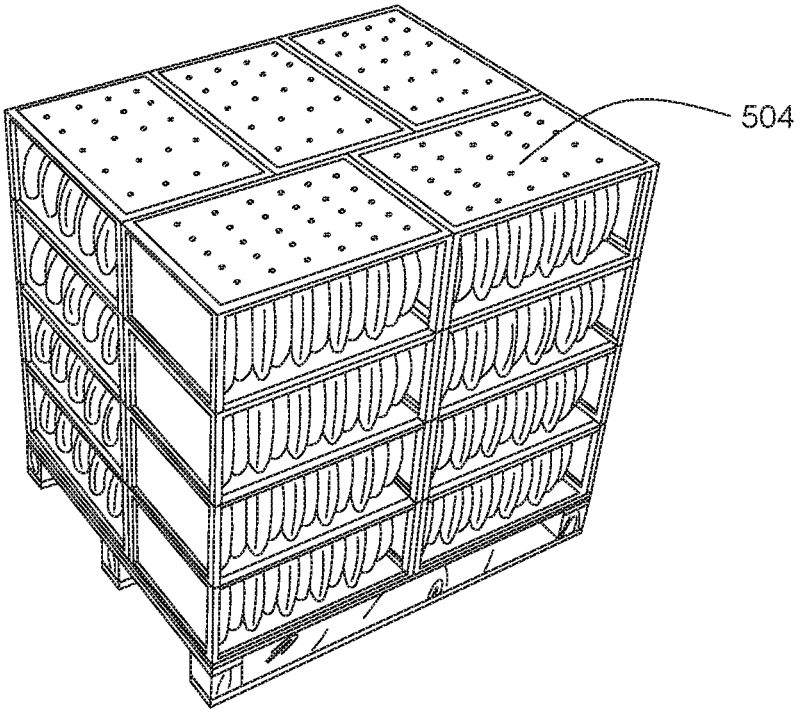
FIG. 11 is a perspective view of boxes of bananas stacked for transport in several layers, in accordance with some embodiments.

Referring now to FIGS. 10-11, an example of a stack of containers for transportation is depicted. In one embodiment, the containers 500 may be stacked in a 5 down configuration, such that the containers 500 may be efficiently stacked for transportation. As shown here, the side wall 506 is removed or transparent to illustrate how bananas are transported in a generally vertical arrangement. In other embodiments, the containers 500 may be stacked in a 6 down configuration, 8 down configuration, 10 down configuration, or any other configuration that allows for the efficient stacking and transportation of the containers 500. While FIGS. 10-11 depict the bottom wall 508 being made of a transparent material, it is appreciated that the bottom wall 508 may be made of a solid material, such as plastic, cardboard, wood, metal, or the like.

Figure 12:
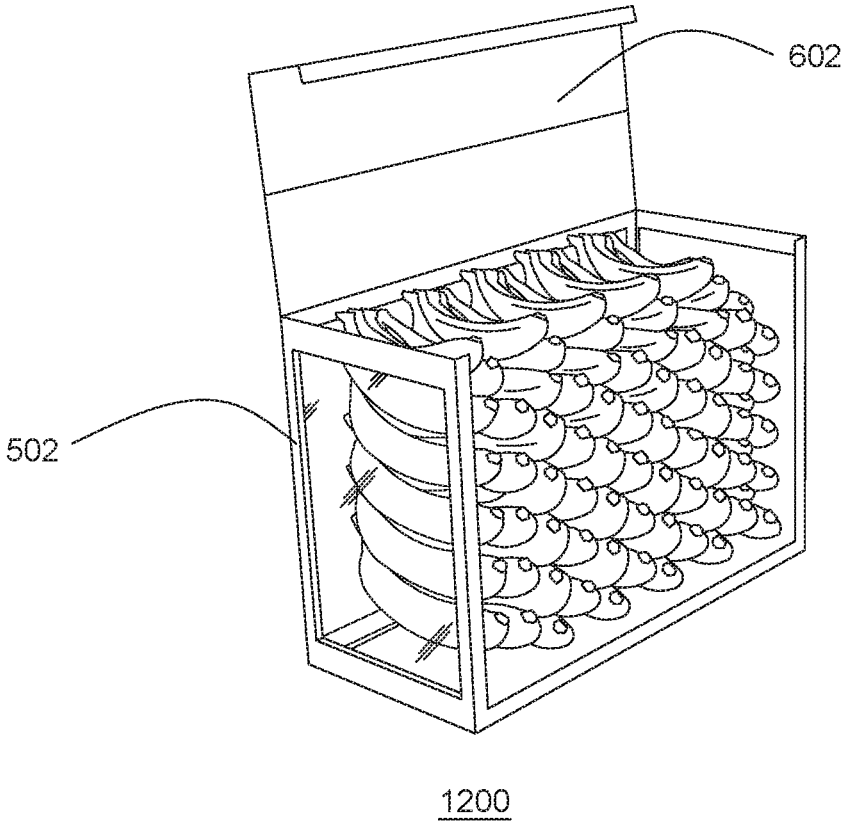
FIG. 12 is a perspective view of a box opened for display of bananas, in accordance with some embodiments.

Referring now to FIG. 12, the container 500 is shown in a display configuration 1200. In the display configuration 1200, one perimeter wall 602 may be folded away, or removed from the container 500, such that the bananas are accessible to a user. The perimeter wall 602 may include a space for a sign, such as an advertisement or a price for the bananas, which may be viewable when the perimeter wall 602 is folded as shown in FIG. 12. As such, the container 500 may be used to display bananas for retail. Alternatively, the bananas may be removed from the container and displayed on a separate case in the retail location. Since the bananas in the container 500 are stacked side-by-side and on top of each other (as opposed to the prior art packing method shown in FIG. 4), minimal labor is required to unpack the container 500 and display the bananas outside of the container 500. For example, a user may place the container 500 on a display table in a retail location in the configuration shown in FIG. 9 (i.e., the bananas are oriented substantially perpendicular to the display table). A user may then detach the covering 702 from the container 500, and may remove at least the top wall 504 from the container 500 by lifting the top wall 504 vertically away from the container 500. The bananas may then drop away from the container 500 and to the display table, with the covering 702 remaining underneath the bananas. A user may then unfold the covering 702 along the display table until the covering 702 is substantially flat against the display table, creating space for the bananas to lay horizontally against the display table. The concave faces of the banana clusters may then face potential customers of the retail location, as is generally the preferred orientation for displaying bananas, allowing the customers to easily view stickers and advertisements placed on the bananas. Accordingly, the container 500 would allow for the cost-effective display of bananas outside of the container 500, in addition to inside of the container 500.

Figure 13:
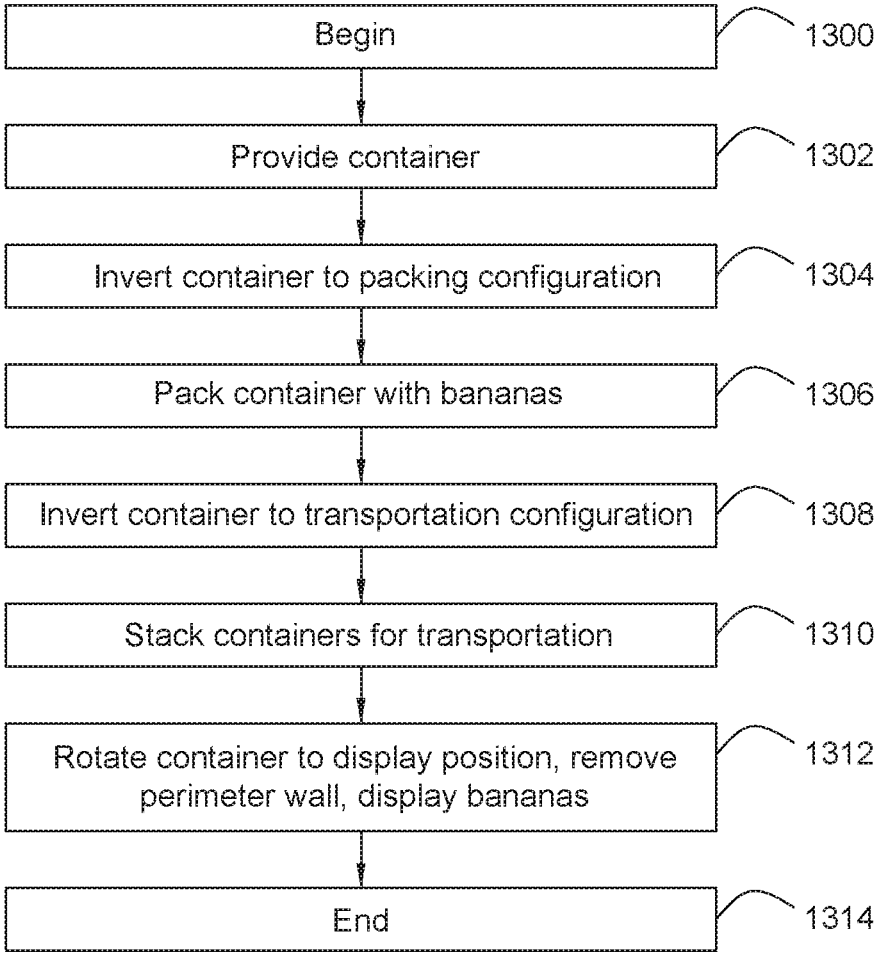
FIG. 13 is a flow chart of a method for loading bananas or similar fruit into a box for packaging and transport, in accordance with some embodiments.

Referring now to FIG. 13 in particular, with reference to FIGS. 1-12, a method of using a container 500 is described in greater detail. Although FIG. 13 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 13 for the sake of brevity. In some embodiments, some or all of the process steps included in FIG. 13 can be combined into a single process.

The method of using the container 500 begins at step 1300 and proceeds directly to step 1302, in which the container 500 is provided with the features and configurations described herein above. The method of using the container 500 may then proceed to step 1304, which includes inverting the container to the packing configuration, as shown in FIGS. 6-8, with the perimeter wall 602 resting on a surface, such as a ground surface, pallet, table, or bench. The method of using the container 500 may continue to step 1306, during which the container 500 is packed with bananas. During step 1306, the bananas may be enclosed within covering 702, thereby suspending the bananas between top wall 504 and bottom wall 508.

The method of using the container 500 may continue to step 1308, which includes inverting the container 500 to the transportation configuration, as shown in FIG. 9. In the transportation configuration, the bottom wall 508 may rest on a surface, such as a ground surface, pallet, table, or bench. The method of using the container 500 may then proceed to step 1310, in which containers 500 are stacked for transportation, as shown in FIGS. 10-11. The containers 500 may be stacked in a 5 down configuration, 6 down configuration, 8 down configuration, 10 down configuration, or any other configuration that provides for the safe and efficient stacking and transportation of bananas within the containers 500.

The method of using the container 500 may then continue to step 1312, in which the container is inverted into a display position with a perimeter wall removed, and the bananas within the container 500 may be displayed in a retail location, as shown in FIG. 12. Alternatively, the container 500 may be emptied of its contents in a quick, safe, and efficient way, due to the method of storing the bananas within the container 500, and displayed at a separate location within the retail location. One effective way of displaying bananas outside of the container 500 is discussed in detail above, but it is appreciated that other methods of efficiently removing the bananas from the container 500 for display are also possible. The container 500 may then be disposed of; alternatively, the container 500 may be reusable, and may be utilized again in the transportation of other materials, including bananas. The method of using the container 500 ends at step 1314.

Figure 14:
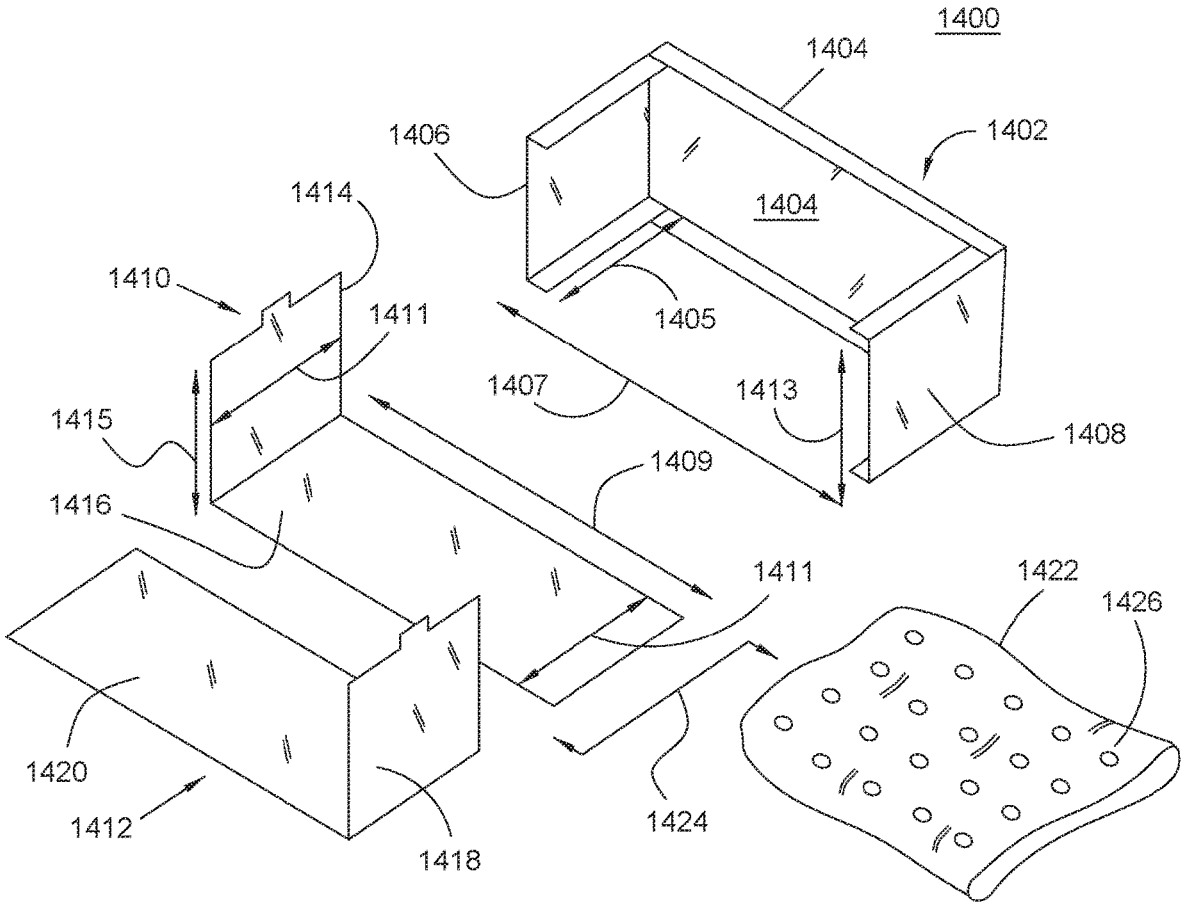
FIG. 14 is an exploded view of a box and packaging system for bananas and similar fruits, in accordance with some embodiments.

FIG. 14 is an exploded view of a box and packaging system 1400 for bananas and similar fruits, in accordance with some embodiments. The packaging system includes a box frame 1402 that includes a top wall 1404, and opposing short sides 1406, 1408 that define an interior of the box frame. As shown here, the box frame 1402 is laying on one of its opposing long sides, which are longer than a width of the opposing short side 1406, 1408. The opposing short sides 1406, 1408 are shown here as side walls, but can, in some embodiments, be open, like the long sides between them. The opposing long sides are spanned by first and second opposing perimeter walls 1410, 1412, respectively. By "spanned" it is meant that the structure being referenced, here the perimeter walls, substantially cover the full width and/or height another corresponding structure, such as the interior of the long sides of the box frame. The perimeter walls 1410, 1412 can be identical in size and shape, having a short side 1414, 1418 the is sized approximate the same as sides 1406, 1408. The short sides 1414, 1418 are integrally attached to long sides 1416, 1420, respectively. The perimeter walls 1410, 1412 can be formed as a long member that is folded to create the long sides 1416, 1420 and the short sides 1414, 1418. The long sides 1416, 1420 of the perimeter walls 1410, 1412 are sized to correspond with, and fit against the long sides of the box frame 1402. That is, the long sides of the box frame 1402 have a length 1407, and a height 1405. Likewise, the length 1409 of the perimeter walls 1410, 1412 is slightly shorter than the length 1407 of the long sides of the box frame 1402. The height 1411 of the perimeter walls 1410, 1412, is just slightly shorter than height 1405 of the box frame. The short sides 1414, 1418 of the perimeter walls 1410, 1412 have the same height 1411 of the long sides 1416, 1420, and a width 1415 that is slightly less than a width 1413 of the sides of the box frame 1402. These dimensions allow the perimeter walls 1410, 1412 to be placed inside the box frame 1402, where the long side 1416, 1420 of the perimeter walls 1410, 1412 become walls for the box frame 1402.

To assemble the box 1400, the perimeter walls 1410, 1412 are arranged as shown, with their long sides 1416, 1420 on the surface on which the box frame 1402 is laying. The long sides 1416, 1420 of the perimeter walls 1410, 1412 are lined up with the bottom of the box frame 1402, and spaced apart from each other and the box frame 1402. A film tube 1422 is then placed over the long sides 1416, 1420 of the perimeter walls as indicated by arrow 1424. The film tube 1422 has a length that can be slightly shorter than the length 1409 of the long sides 1416, 1420 of the perimeter walls 1410, 1412. The circumference of the film tube 1422, in the direction perpendicular to its length, is slightly less than twice the sum of twice the height 1405 and the depth 1413. In other words, it is just slightly too small to encircle the box frame 1402. The film tube 1422 can be provided with a plurality of aeration openings 1426 to allow air to pass through the film tube, which aids in keeping the contents cool during transport, and facilitating a desired ripening time frame.

Figure 15:
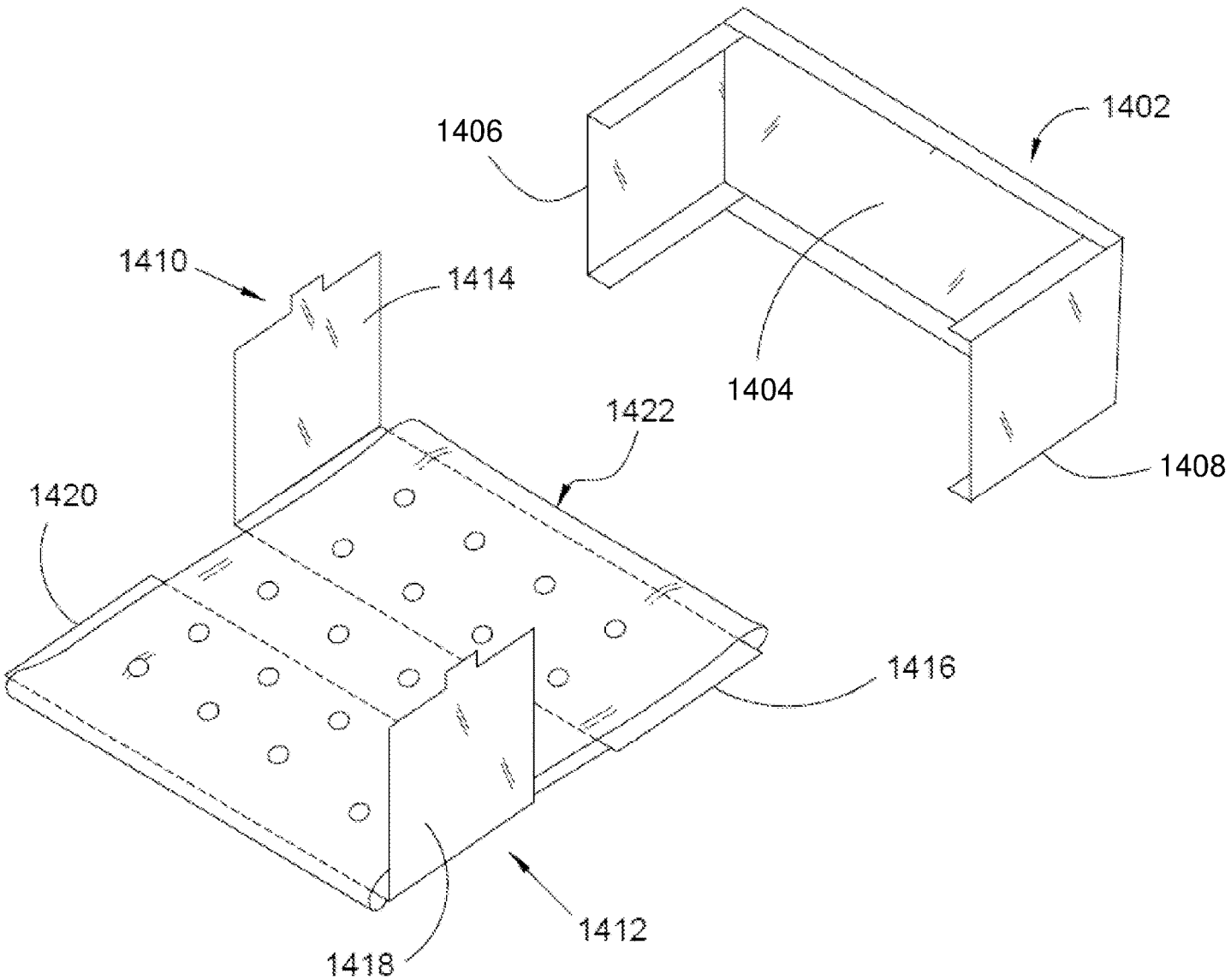
FIG. 15 is an exploded assembly view of the box and packaging system of FIG. 14 partially assembled, in accordance with some embodiments.

FIG. 15 is an exploded assembly view of the box and packaging system of FIG. 14 partially assembled, in accordance with some embodiments. In this stage of assembly, the film tube 1422 is placed over the long sides 1416, 1420 of both perimeter walls 1410, 1412, so that the long sides 1416, 1420 are inside the film tube 1422, thereby encircling the long sides 1416, 1420 with the film tube 1422. Note that there is a space between the perimeter walls 1410, 1412 that is slightly less than the depth 1413 of the box frame 1402. Configured as shown, the box assembly is ready for loading.

Figure 16:
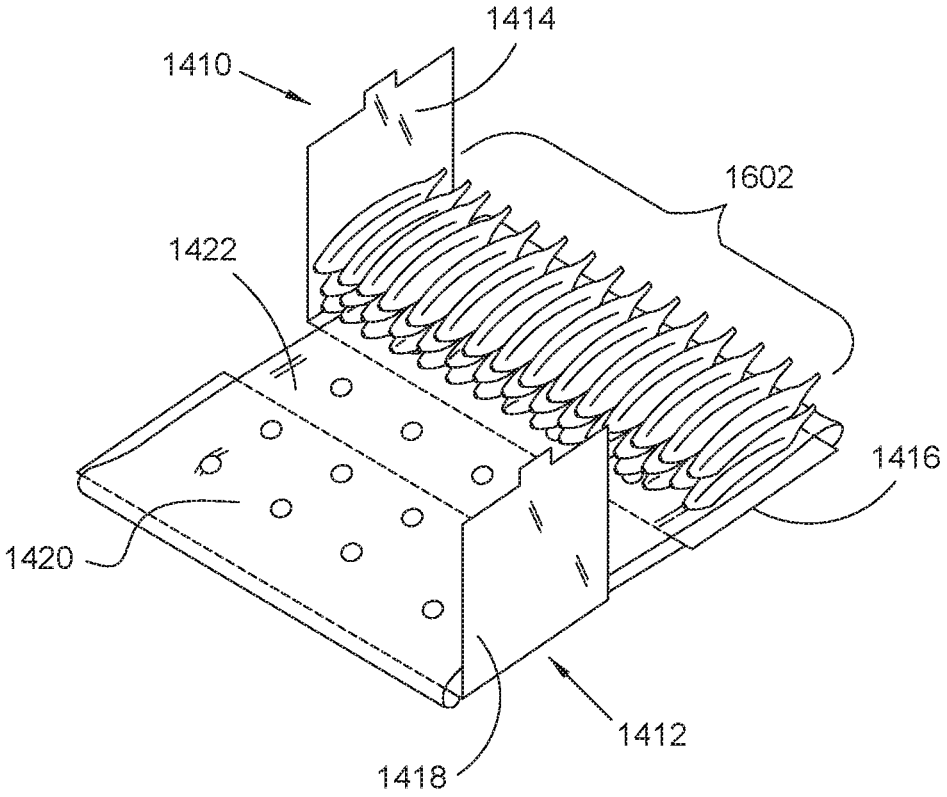
FIG. 16 is a perspective view of the sides of a box and packaging system of FIG. 14, partially assembled, with bananas loaded or stacked thereon, in accordance with some embodiments.
Figure 20:
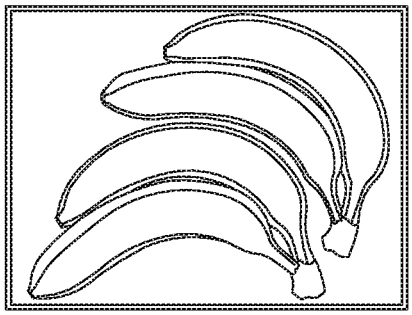
FIG. 20 is an end view of bananas in a loading configuration in a box and packaging system, in accordance with some embodiments.

FIG. 16 is a perspective view of the sides of a box and packaging system of FIG. 14, partially assembled, with bananas loaded or stacked thereon, in accordance with some embodiments. The perimeters walls 1410, 1412, and film tube 1422 are shown substantially in the same state as shown in FIG. 15. Bananas 1602 or a similar fruit or vegetable are then placed onto the long side 1416 of the first perimeter wall 1410, on top of the film tube 1422. The bananas 1602 are stacked with the bunched ends toward the top of the box frame, and the free ends oriented in the opposite direction as seen in FIG. 20. In some embodiments, the bananas 1602 are stacked in two layers of bunches spanning the long side 1416 of the first perimeter wall 1410.

Figure 17:
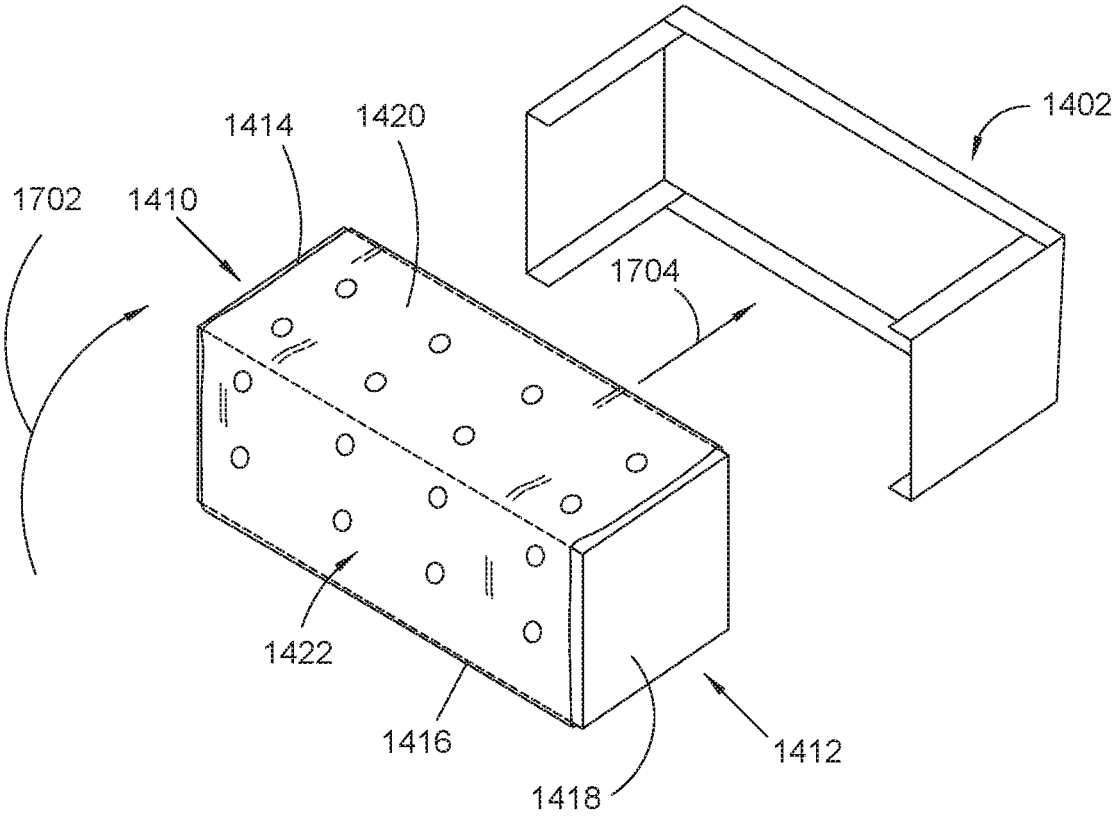
FIG. 17. is a perspective view assembly view of the sides of the box with the bananas being loaded into a box frame, in accordance with some embodiments.

FIG. 17. is a perspective view assembly view of the sides of the box with the bananas being loaded into a box frame, in accordance with some embodiments. Continuing from the stage of FIG. 16, the second perimeter wall 1420 is brought up, over the bananas, and inverted, as indicated by arrow 1702. As a result, the long side 1420 of perimeter wall 1412 is now over and on top of the bananas, separated from them by one layer of the film tube 1422. Once in this state, the perimeter walls 1410, 1412 with the bananas and film tube 1422 cane be placed into the box frame 1402.

Figure 18:
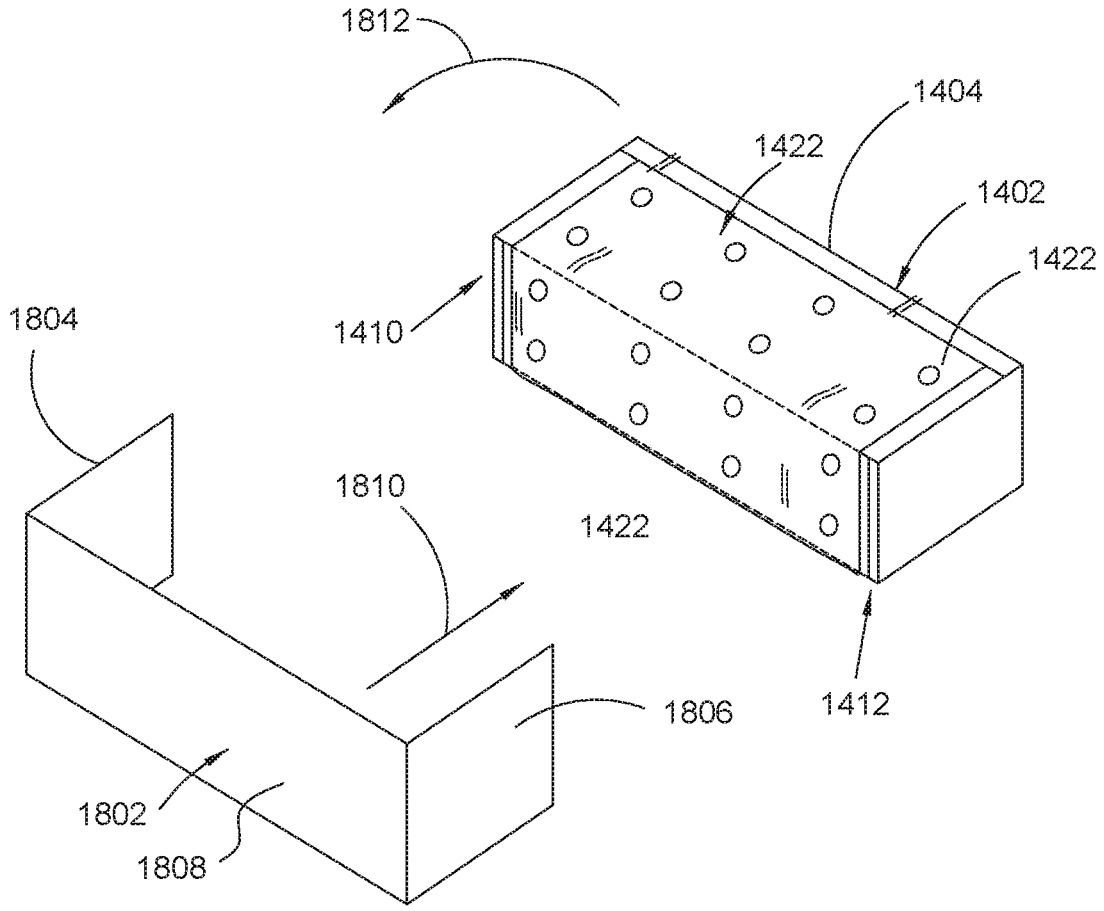
FIG. 18 is a perspective view assembly view of the sides of the box with the bananas loaded into a box frame with a bottom being assembled therewith, in accordance with some embodiments.

FIG. 18 is a perspective view assembly view of the sides of the box with the bananas loaded into a box frame 1402 with an optional bottom member 1802 being assembled therewith, in accordance with some embodiments. In this stage the long sides 1416, 1420 of the first and second perimeter walls 1410, 1412 form the sides of the box assembly. The short sides 1414, 1418 of the perimeter walls can have tabs or similar conventional features to be retained in the box frame 1402. Once the bananas, perimeter walls, and film tube are loaded into the box frame 1402 as shown, the box frame 1402 can be rotated up so that the top 1404 is the uppermost portion. In some embodiments a bottom member 1802 can be added for additional support. The bottom member 1802 can include side portions 1804, 1806 that fit into the short sides of the box frame 1402, and a bottom 1808 that forms a bottom to the assembled box packaging system when moved into the box frame 1402 as indicted by arrow 1810. Once assembled, with or without the bottom member 1802, the box assembly can be rotated as indicated by arrow 1812 to an upright position for transport. In some embodiments the bottom member 1802 can be provided in box frame 1402, or as a portion of box frame 1402. The box frame 1402, perimeter walls 1410, 1412, and bottom member 1802 and be made of corrugated cardboard, or similar materials, including plastic, fiberboard, and others, as are known in the art.

Figure 19:
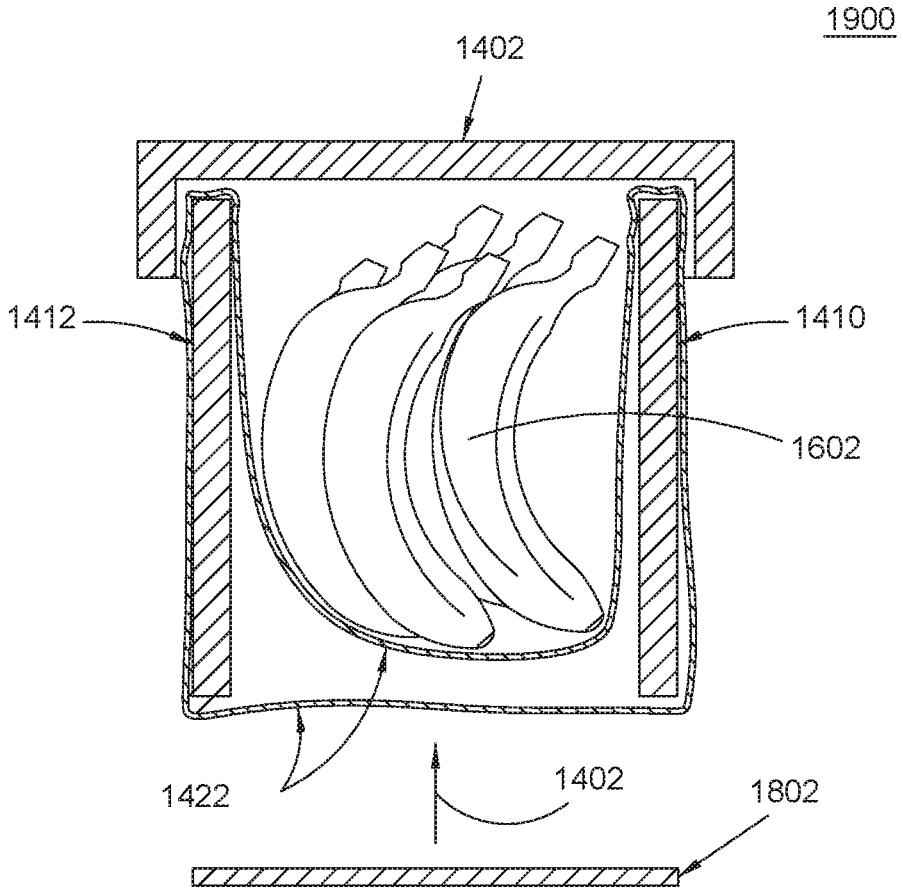
FIG. 19 is an end cut-away view of a loaded box and packaging system for bananas, in accordance with some embodiments.
Figure 21:
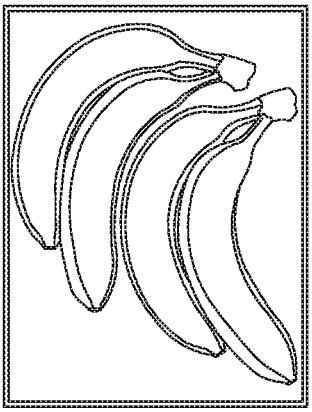
FIG. 21 is an end view of bananas in a transport configuration in a box and packaging system, in accordance with some embodiments.
Figure 23:
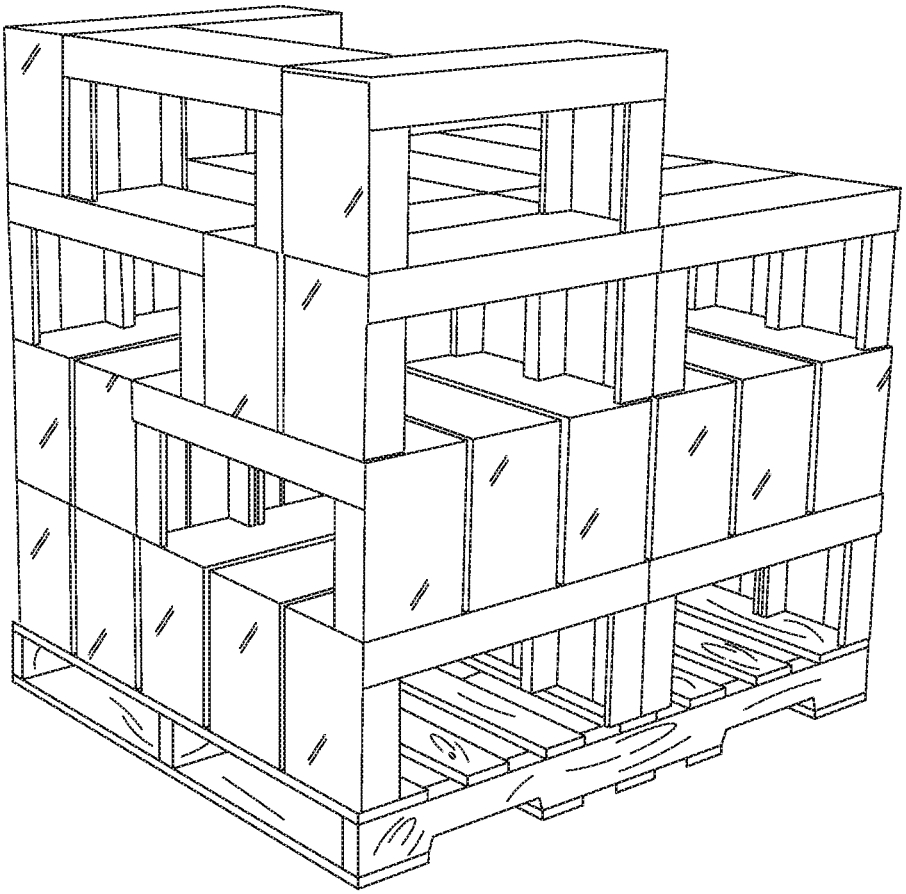
FIG. 23 is a view of a stacked arrangement of boxes for packaging and transporting bananas and similar fruit, in accordance with some embodiments.

FIG. 19 is an end cut-away view of a loaded box 1900 and packaging system for bananas, in accordance with some embodiments. In this stage the loaded, assembled box 1900 has been rotated up (e.g. as indicated by arrow 1812) into a position for transporting the bananas, which will be suspended inside the packaging system by the film tube 1422 material. This view is a cutaway view of the top 1402, perimeter walls 1410, 1412, film tube 1422, and bottom member 1802 (once moved into position as indicated by arrow 1902), exposing the bananas 1602. The film tube 1422 has an inside portion along the inside of the perimeter walls 1410, 1412, and around the bottom of the bananas 1602. The film tube also has an outside portion around the outside of the perimeter walls 1410, 1412, and across the bottom of the loaded box 1900. The film tube is sized so that the bananas are suspended inside the box, and are not against the bottom. This configuration is further exemplified in FIG. 21. If sized correctly, the bananas 1602 are also not against the perimeter walls 1410, 1412 with as much force as they would be without the film tube 1422. Thus, the portion of the film tube 1422 inside the assembled box acts like a hammock to hold the bananas for transport. Groups of assembled boxes can be stacked in layers together on pallets, for example, as shown in FIG. 23. It should be noted than in FIG. 23 only the box frames are shown to indicate one possible stacking arrangement. The perimeter walls, film tube, and bananas would otherwise be included in an actual implementation.

Figure 22:
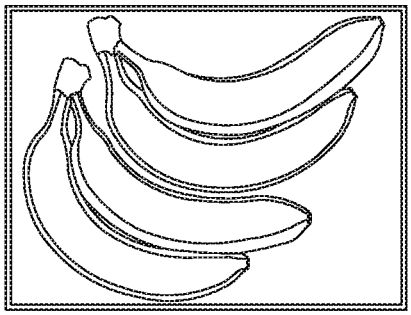
FIG. 22 is an end view of bananas in a display configuration in a box and packaging system, in accordance with some embodiments.

Once the assembled box has arrived at a merchant location and is ready to be opened for display and sale of the banana bunches, the assembled box can be laid over on a long side, as shown in FIG. 18, or inverted from that of FIG. 18. Once laid on its long side, the uppermost perimeter wall can be removed, and the freed film tube portion pulled away to expose the banana bunches contained within the box assembly, as shown, for example, in FIG. 22.

An integrated banana packing, transportation, and commercialization system has been disclosed that is capable of protecting bananas, preventing damage during transportation, and displaying bananas with minimal handling. The integrated banana packing, transportation, and commercialization system allows for the safe and efficient packing, transportation, and display of bananas within a singular container, reducing costs during each phase of the process.

What is claimed is:

1. A method of arranging a container system for packaging, transporting, and displaying bananas, comprising:

providing a box frame having opposing long sides, and opposing short sides, and having a top wall and defining an interior;

providing a first perimeter wall and a second perimeter wall, each having a long side;

providing a film tube that is sized to encircle portions of the first and second perimeter walls;

configuring the first and second perimeter walls adjacent each other on a surface such that the long sides of the first and second perimeter walls are parallel to each other;

placing the box frame on one of the long sides of the box frame;

placing the film tube over the long sides of the first and second perimeter walls such that the long sides of the perimeter walls are inside the film tube;

placing a plurality of bananas on the long side of the first perimeter wall on an outside of the film tube;

inverting the second perimeter wall over, and on top of the bananas and the first perimeter wall;

after inverting the second perimeter wall, placing the first and second perimeter wall and the film tube with the bananas captured between the first and second perimeter walls into the interior of the box frame; and rotating the box frame with the bananas contained therein into an upright position;

wherein in the upright position, the bananas are suspended in the interior of the box frame between the first and second perimeter walls by the film tube.

2. The method of claim 1, further comprising:

providing a bottom member having opposing sides that each fit within the box frame along a respective one of the opposing sides of the box frame, and a bottom that is sized to cover a bottom of the box frame; and placing the opposing sides of the bottom member into the interior of the box frame, thereby forming a bottom of the container system.

3. The method of claim 1, wherein providing the first and second perimeter walls comprises:

providing each of the first and second perimeter walls with a short side that is contiguous with the respective long side of each of the first and second perimeter walls, wherein the short side of each of the first and second perimeter walls is sized to fit against a respective one of the opposing short sides of the box frame within the box frame.

4. The method of claim 1, further comprising:

converting the container system from a transport configuration to a display configuration by:

placing the box frame with the bananas disposed in the interior of the box frame on a surface of one of the long sides of the box frame; and removing the one of the first and second perimeter walls that is uppermost upon placing the box frame on the long side.

5. The method of claim 1, wherein providing a film tube comprises providing the film tube including a plurality of aeration openings.

6. The method of claim 1, wherein providing the box frame further comprises providing the box frame having a length of 23 to 24 inches, a height of 10 to 11 inches, and a depth of 7 to 8 inches.

* * * * *